US005528809A

United States Patent [19]

Green et al.

[11] Patent Number: 5,528,809

[45] Date of Patent: Jun. 25, 1996

[54] DUAL-SIDED BUSHING INSTALLATION TOOL FOR VEHICLE TRANSMISSIONS

[76] Inventors: Jace N. Green, 1635 Briar Rose Pl. #283, Salt Lake City, Utah 84104; Blaine F. Green, 40 Edison, Murray, Utah 84107

[21] Appl. No.: 181,857

[22] Filed: Jan. 14, 1994

[51] Int. Cl.[6] ..... B25B 27/14

[52] U.S. Cl. ..... 29/275

[58] Field of Search ..... 30/119, 358–368; 72/412, 324, 478, 477; 227/151; 173/90, 131, 132, 128; 81/463; 29/275, 254–255; 90/275

[56] References Cited

U.S. PATENT DOCUMENTS

| | | | |
|---|---|---|---|
| 1,863,956 | 6/1932 | Wilson | 29/275 |
| 2,861,330 | 11/1958 | Kratz | 29/275 |
| 3,099,079 | 7/1963 | Stein | 29/275 |
| 3,099,876 | 8/1963 | Lawless | 29/275 |
| 3,393,439 | 7/1968 | Shriver . | |
| 4,042,788 | 10/1977 | Hastings et al. . | |
| 4,050,148 | 9/1977 | Hastings . | |
| 4,586,228 | 5/1986 | Rodolf . | |
| 4,794,683 | 1/1989 | Pacheco . | |
| 4,823,468 | 4/1989 | Kollegger | 30/360 |
| 4,894,899 | 1/1990 | Hamatani . | |
| 4,951,374 | 8/1990 | Barry . | |
| 5,042,132 | 8/1991 | Hardin . | |
| 5,218,749 | 6/1993 | Upthegrove | 30/358 |

*Primary Examiner*—Robert C. Watson
*Attorney, Agent, or Firm*—Thorpe, North & Western

[57] ABSTRACT

A dual-sided, reversible bushing installation tool having two support cylinders for receiving bushings thereon. The cylinders are disposed upon opposing surfaces of a circular stopping flange and extend outward therefrom. Each cylinder has a substantially different outer diameter than the other to permit installation of bushings having two different inner diameter sizes. A passage extends axially through the tool between opposing ends of the cylinders, such that the cylinders, the flange and the passage are in co-axial orientation. An impact transferring handle includes a positioning finger for insertion into either end of the passage.

13 Claims, 3 Drawing Sheets

DUAL-SIDED BUSHING INSTALLATION TOOL FOR VEHICLE TRANSMISSIONS

BACKGROUND OF THE INVENTION

1. The Field of the Invention

The present invention relates generally to tools for installing bushings in vehicle transmissions. More particularly, it concerns a dual-sided, reversible tool for press-fitting a bushing into an annular cavity of a vehicle transmission at a predetermined depth therein.

2. The Background Art

Vehicle transmissions generally have lubricated, rotational cylindrical members which rotate within an annular cavity of a drum or some other type of housing structure. The rotational cylindrical member and the housing structure cooperatively define an annular passage therebetween. Lubricant is dispersed within such annular passages to maintain lubrication of the cylindrical members. It is known to install sealing rings over the cylindrical members to seal off at least portions of the annular passages to thereby channel the lubricant into a desired flow path. The life of the sealing rings is substantially increased with the use of bushings as known in the art.

A bushing is generally a solid metallic ring, commonly made from babbitt or copper. Bushings are typically press fitted into the annular cavity. The inner diameter of a bushing is narrowly tailored to match closely the outer diameter of the rotational cylindrical member after installation. One or more bushings slidably circumscribe thee cylindrical member to provide a rotational, bearing-type support and, perhaps more importantly, to maintain the cylindrical member in a lateral alignment. The bushings, in effect, prevent the cylindrical member from wobbling about and stretching and wearing against the sealing rings. Some bushings include lubrication slots in their interior surface to allow passage of lubricant between the bushing and the cylindrical member.

The necessity of bushings has motivated the development of various tools and methods for installation. It is known to install a bushing by placing it on the end of a steel cylindrical installer and pounding the cylinder with a hammer to press fit the bushing into an annular receiving cavity. However, this method is fraught with disadvantages. The hardness of steel installers causes damage to the bushing, and the ductility of the steel causes the installer to gradually deform from the pounding. In addition, the lack of resilience in steel inhibits transfer of impact energy from the hammer to the bushing, requiring more force and effort to install bushings.

It is time consuming and expensive to make bushing installers from steel, and thus more difficult to custom tailor the bushing installer to a specific bushing size. Moreover, the prior art installers known to applicant are not reversible and do not fit exactly every bushing. For example, the installers are usually manufactured to standard diameter sizes in one-inch increments. A user selects the installer which is closest to the size desired, rarely finding an optimal installer size for every bushing. The known steel installers are also of limited utility for installing other transmission apparatus.

It is important that bushings be installed to a certain depth within their annular receiving cavities. Improperly installed bushings have been known to block lubrication holes and interfere with the operation of thrust washers and other transmission apparatus. However, none of the prior art installers known to applicant have any depth control structure. Rather, they require the operator to use experience and perception to press fit a bushing to the proper depth within the annular receiving cavity. It is therefore a common occurrence for a mechanic to install a bushing too far into its annular receiving cavity, or not far enough. This requires additional time and energy to remove and/or reposition the bushing without damaging it using a steel installer.

OBJECTS AND SUMMARY OF THE INVENTION

It is therefore an object of the present invention to provide a bushing installation tool for quickly and easily installing bushings into annular vehicle transmission cavities.

It is an additional object of the invention to provide such a tool that is inexpensive and can be made quickly.

It is another object of the invention to provide such a tool which is reversibly useable to install bushings from either of two opposing sides of the tool.

It is a further object of the invention to provide such a tool which minimizes damage to the bushing during installation.

It is still another object of the invention, in accordance with one aspect thereof, to provide such a tool which is useable to install having at least two different inner diameter sizes.

It is yet another object of the invention, in accordance with one aspect thereof, to provide such a tool which controls the insertion depth of a bushing.

It is an additional object of the invention, in accordance with one aspect thereof, to provide such a tool which is useable with a foot press apparatus.

It is a further object of the invention, in accordance with one aspect thereof, to provide such a tool which is useable to install other transmission apparatus in addition to bushings.

The above objects and others not specifically recited are realized in an illustrative embodiment of a dual-sided bushing installation tool having two support cylinders for receiving bushings thereon. The cylinders are disposed upon opposing surfaces of a circular flange and extend outward therefrom. The cylinders preferably have substantially different diameters to permit installation of bushings having two different inner diameter sizes. A passage extends axially through the tool between opposing ends of the cylinders, such that the cylinders, the flange and the passage are in co-axial orientation. An impact transferring handle includes a positioning finger for insertion into either end of the passage. A user places a bushing on one of the support cylinders, places the handle into the other of the cylinders, and delivers an impact force on the end of the handle to press fit the bushing into an annular cavity.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
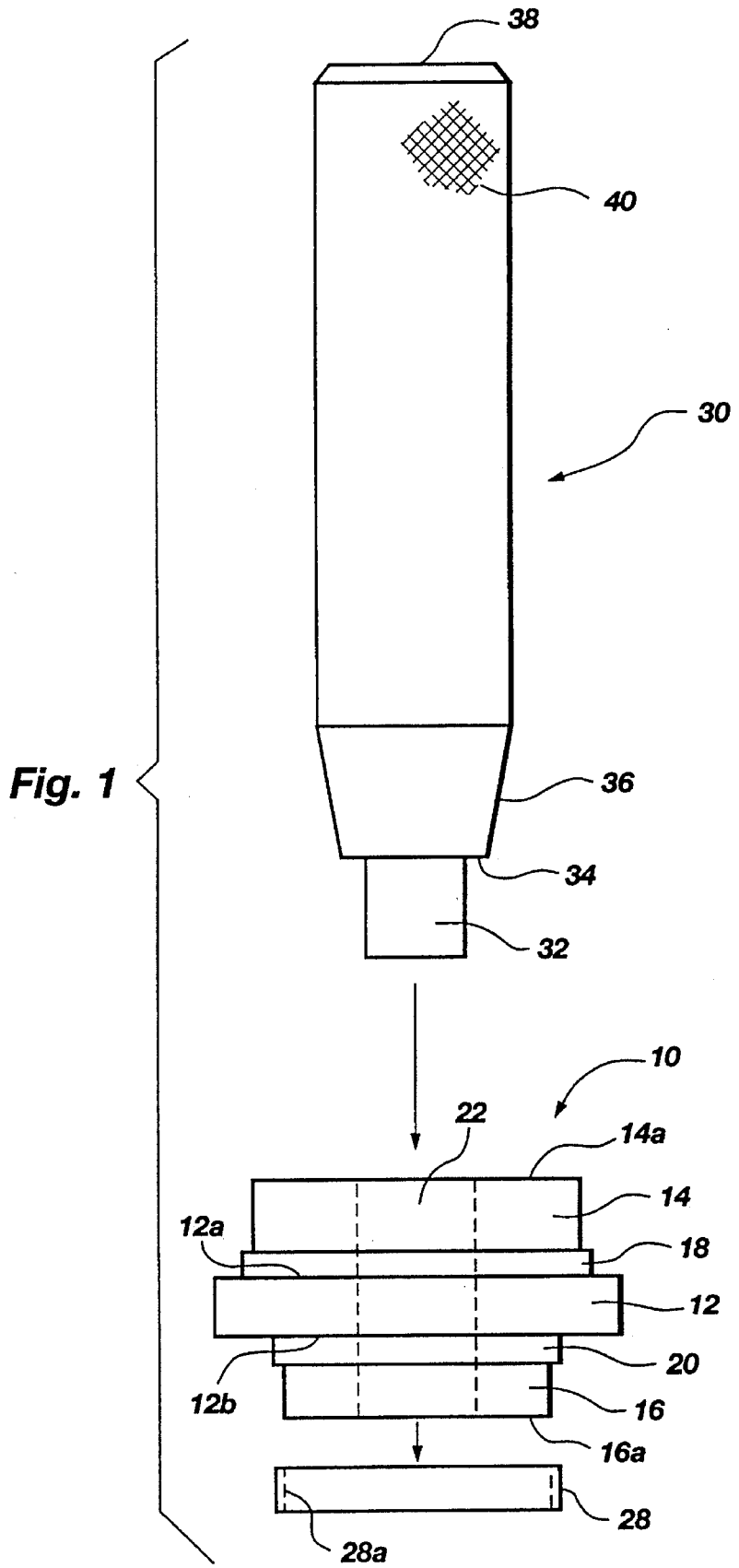
FIG. 1 illustrates a side view of a dual-sided, reversible bushing installation tool, made in accordance with the principles of the present invention, in conjunction with additional cmponents.

Reference will now be made to the drawings wherein like structures will be provided with like reference numerals.

Figure 2:
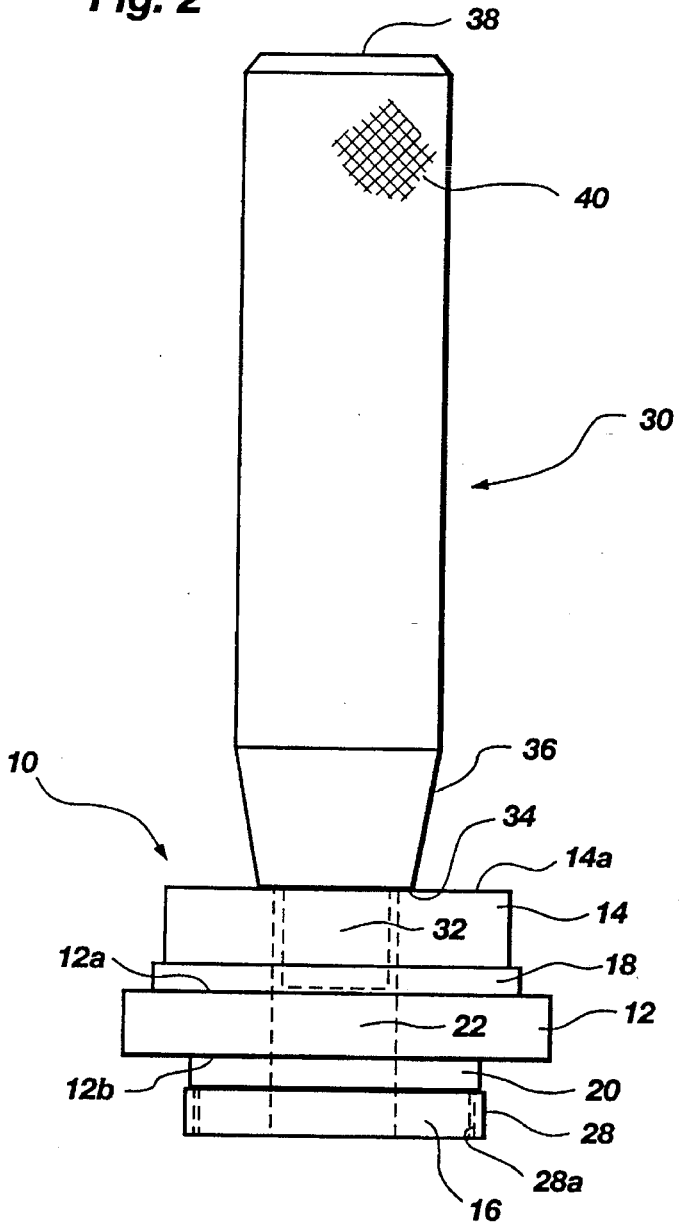
FIG. 2 illustrates an assembled, side view of the bushing installation tool and handle of FIG. 1, with portions thereof shown in phantom line.
Figure 3:
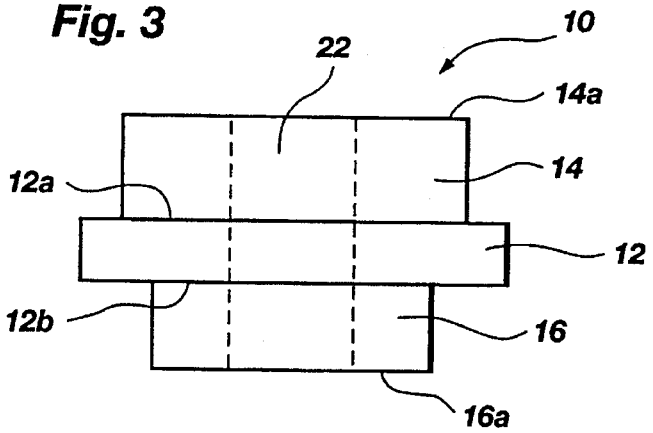
FIG. 3 illustrates a side view of an alternative embodiment of the bushing installation tool of FIGS. 1–2.

FIGS. 1–3 illustrate the main features of a dual-sided, reversible bushing installation tool, generally designated at 10, in association with an elongate, impact-transferring handle driver 30 and a bushing 28. The tool 10 includes a circular stopping flange 12 having first and second opposing, substantially flat surfaces 12*a* and 12*b*, respectively, lying in substantially parallel planes. First and second impact-transferring support cylinders 14 and 16 are disposed on the stopping flange surfaces 12*a* and 12*b*, respectively, and extend axially outward therefrom in opposite directions. The cylinders 14 and 16 terminate in free ends and include an end face 14*a* and 16*a*, respectively, and preferably have different outer diameters as shown.

First and second annular rims 18 and 20 are respectively disposed on the first and second flange surfaces 12*a* and 12*b* and circumscribe the first and second cylinders 14 and 16, respectively. The rims 18 and 20 have predetermined, shorter lengths than their respective cylinders 14 and 16 as shown. A passage 22 extends axially between the end faces 14*a* and 16*a* through the entire tool 10, such that the cylinders 14 and 16, the rims 18 and 20, the stopping flange 12, and said passage are all in co-axial orientation. It is preferable that all elements of the tool 10 be circular and co-axial, including the flange 12, and cylinders 14 and 16, the rims 18 and 20, and the passage 22.

The handle driver 30 includes a positioning finger 32 disposed on a distal end face 34 thereof. The finger 32 extends axially outward from said distal end face in substantial co-axial orientation with the handle 30. The handle further includes a tapered portion 36, an impact receiving end 38, and an at least partially knurled, exterior surface designated at 40.

The finger 32 is configured for insertion into the passage 22 in either of the end faces 14*a* and 16*a* of the tool 10 as shown in FIG. 1. Similarly, the cylinders 14 and 16 are custom designed for insertion into specific bushing sizes, as shown in FIG. 1 with cylinder 16 being inserted into the bushing 28. The bushing 28 includes an interior surface 28*a* shown in phantom line. After insertion of the handle 30 into the passage 22 in one of the cylinders, and the other of the cylinders into a bushing 28, the tool 10 appears as shown most clearly in FIG. 2.

The cylinders 14 and 16 and their associated rims 18 and 20 are custom designed to fit specific bushings. It is preferred that the outer diameter of the rims do not exceed the outer diameter of the respective bushings which rest against them during installation. For example, inspection of FIG. 2 reveals that the bushing 28 has an outer diameter which is larger than the outer diameter of the rim 20. It is also preferred that the outer diameter of the cylinders 14 and 16 be sufficiently smaller than the inner diameters of the bushings they support during installation to enable a loose fit. Further inspection of FIG. 2 reveals a gap between bushing interior surface 28*a* and the outer surface of support cylinder 16. This enables the tool 10 to be removed after installation of the bushing 28 despite any necessary radial contraction of the bushing during the press fitting procedure. The purposes of the dimensional particulars noted above will be apparent from the following discussion.

Figure 4:
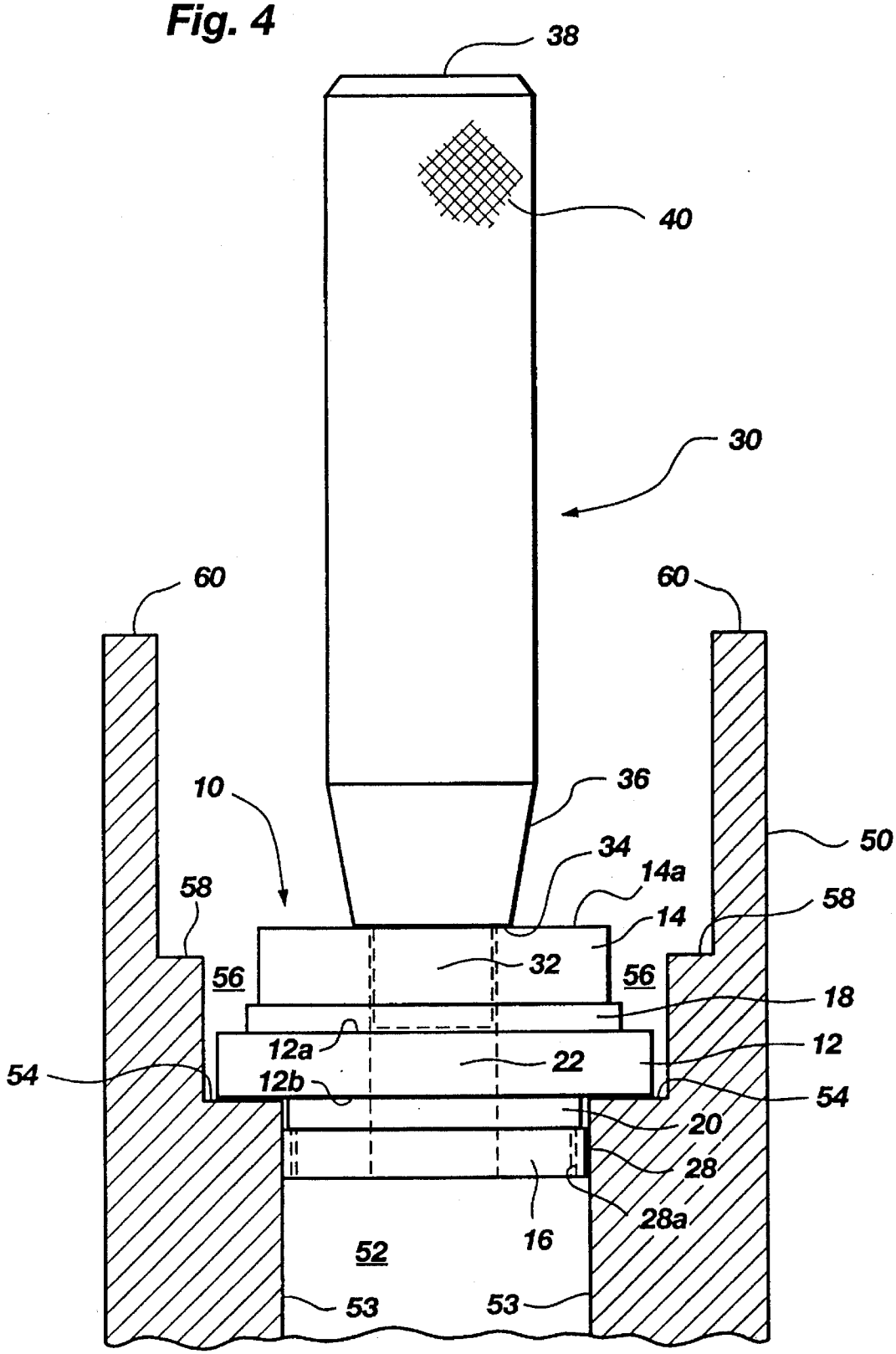
FIG. 4 illustrates the bushing installation tool of FIG. 2 in conjunction with a side, cross-sectional view of a vehicle transmission component.

FIG. 4 shows a transmission component 50 (such as a drum) having an annular cavity 52 for receiving a bushing 28. Referring now to FIG. 4, bushings are press fitted into the annular cavity 52. A bushing is designed to have a slightly larger outer diameter than the annular cavity 52 into which it is pressed, hence the phrase "press fit" or "interference fit". The bushing contracts during the press fitting procedure and thereby exerts an outward radial force against the walls of its receiving cavity, causing it to remain in a tight, seated position. It is thus the press fit which holds the bushing in place.

A principle aspect in accordance with the invention is depth control. The rims 18 and 20 operate as depth settings. Referring to FIG. 4, a user installs the bushing 28 by sliding it onto the cylinder 16 as shown, placing it at the desired annular receiving cavity 52, and delivering an impact force to the end 38 of the handle 30 with a hammer to press the bushing into the annular bushing receiving cavity 52. As such, the cylinders 14 and 16 are preferably rigidly disposed on the stopping flange surfaces 12*a* and 12*b*, respectively, and are uniformly cylindrical along their lengths when so rigidly disposed as shown in FIGS. 1–4, so as to be physically configured to receive a bushing slidably over their free ends in a close fit thereon. During installation, the flange 12 eventually engages with transmission structure such as a flat face 54, to thereby prevent further advancement of the bushing into the cavity 52. The depth of the bushing 28 into its receiving cavity 52 is determined by the length of the operative rim (20 in FIG. 4). This will be more fully explained below.

It will thus be appreciated that in order for the rim 20 to go where the bushing 28 has gone, the outer diameter of said rim must not exceed the outer diameter of the bushing 28. Further, since the bushing 28 contracts during the press fitting procedure, it is preferred that the outer diameter of the rim (20 in FIG. 4) be smaller than the outer diameter of the bushing 28 to ensure that the rim can go where the bushing has gone.

It will further be appreciated that the contraction of the bushing 28 during installation makes it desirable to tailor the cylinder 16 to have an outer diameter which is somewhat smaller than the inner diameter of the bushing. The radial clearance gap between bushing inner surface 28*a* and the outer surface of cylinder 16 is preferably 0.005 inches or more. This enables a user to remove the tool 10 from the bushing 28 after installation, despite any contraction of the bushing. If the fit of the bushing 28 on the cylinder 16 was tight initially, that bushing would contract around the cylinder and prevent removal of the tool 10. It is also preferable that the length of the operative rim (20 in FIG. 4) be within ±0.002 inches of the desired depth of the bushing 28 into the cavity 52. It is further preferred that the clearance gap between the operative rim (20 in FIG. 4) and an interior surface 53 defining the cavity 52 be 0.005 inches or more.

Another principal aspect in accordance with the invention is the reversible nature of the tool 10 to enable installation of two different bushing sizes. The handle 30 in accordance with the present invention does not fit around, but into, the cylinders, and can therefore be used on either end of the tool 10; hence, reversibility. The cylinders 14 and 16 can be the same or different lengths, but it is preferred that the length of a particular cylinder not exceed the length of the bushing to be installed therewith. The length of the finger 32 is not important, but preferably does not exceed the length of the passage 22. The features of the tool 10 enables one to design each cylinder 14 and 16 to fit different bushing sizes, such that each tool 10 can by custom tailored to install two different sizes of bushings.

It is to be understood that the tool 10 may comprise a number of different embodiments in accordance with the present invention. For example, instead of a passage 22, the tool may include two slots formed within the end faces 14*a* and 16*a*. The cylinders 14 and 16 may alternatively have identical outer diameters instead of different sized diameters. Instead of the rims 18 and 20, the tool 10 may include other depth-controlling structure, such as spaced pegs, flanges and so forth. When it is desired to "flush mount" a bushing to be flush with an end of its annular receiving cavity, the rims 18 and 20 can be eliminated as in FIG. 3. In this embodiment, the flange 12 itself operates as the depth control, in that said flange engages with transmission structure during press fitting to thereby achieve the flush mounting of the bushing.

It is preferred that the tool 10 and the handle 30 be made from a polyacetal material. There are two types of acetal known to applicant: a copolymer such as CELCON™ Copolymer of the Celanese company, and a homopolymer such as DELRIN™ Homopolymer of the DuPont company. These acetals are highly crystalline, strong, hard and rigid, and they have good sliding properties. They have low moisture absorption to thereby maintain consistent mechanical properties. Certain of these polymerized acetals are available which offer high resistance against hydrolysis, strong bases, thermal-oxidative degradation and wear, and which have high mechanical strength and stiffness. Further, such polyacetals offer excellent resilience, high fatigue strength, good creep resistance, good impact strength even at low temperatures, and high dimensional stability. This polyacetal material is toolable and moldable.

The resilience of the polyacetal material in combination with the invention achieves a tool capable of a higher degree of energy transfer and which is less damaging than steel. Hence, installation of bushings with the invention requires much less force and effort. As a further unexpected property of the polyacetal material, the energy of the impact does not rebound back out of the tool as with steel. However, the polyacetal is not as hard as steel, enabling the user to deliver an impact force on the end 38 of the handle 30 without fear that the tool 10 will damage the bushing 28.

It will be appreciated that when the tool 10 is made of a polyacetal and includes an end face 14*a* and\or 16*a* having a diameter in a range of approximately three inches to three and one-half inches, the tool suddenly has numerous other uses. For example, the resilient, softer properties of polyacetal as compared with steel permit the tool 10 to be very useful for installing bearings and bearing races in the transmission. A user can simply place the flat surface of the end face 14*a* or 16*a* on the bearings or the races, and tap them in place therewith by tapping on the opposing end of the tool 10 or even on the handle 30 placed in said opposing end.

It will be further appreciated that the embodiments of the tool 10 shown in FIGS. 1–3 with the passage 22 are useful with foot presses and similar devices as known in the art. A user can insert the operative elongate arm of a press into the passage 22 of the tool 10 having a bushing on its lower support cylinder. A pin can be inserted through the operative press arm to secure the tool 10 thereon, and the press can be operated to press the bushing into its annular receiving cavity.

Another principle aspect in accordance with the invention is the custom nature of the tool 10, and the convenience associated with forming the tool 10 specifically from the dimensions of the bushing and its surrounding transmission structure. Each year, new transmissions come into the market with new bushing sizes. This makes standard sized bushing kits somewhat limited in their usefulness. A custom-tailored bushing installer is much more effective during installation because it properly channels the impact force of the hammer and helps prevent damage to the bushing. A standardized, generic installer which is too large for the bushing may be difficult to remove after installation as noted above. Conversely, an installer which is too small may strip or otherwise damage the bushing during installation.

It is useful for the following discussion to note that an annular cavity 52 for receiving a bushing is typically formed in a flat face 54 of a transmission component 50. The flat face 54 is generally perpendicular to the annular bushing receiving cavity 52. The flat face 54 often defines the end of a larger annular cavity 56, and can even be one of a series of stepped faces (58 and 60) defining the extremes of progressively larger annular cavities. The particular flat face 54 in which the annular bushing receiving cavity 52 is formed shall be referred to herein as the first flat face 54. The method for making the tool 10 in accordance with the present invention involves the following steps:

(1) selecting a vehicle transmission component having an installed bushing which has preferably been installed by the transmission manufacturer;

(2) measuring and recording the inside diameter of the installed bushing (measurement A);

(3) measuring and recording the installed depth of the bushing (measurement B); (Measurement B is a measurement from the first flat face to the upper edge of the installed bushing.)

(4) measuring and recording the diameter of the annular bushing receiving cavity (measurement C);

(5) measuring and recording the diameter of the first flat face, which defines a larger cavity immediately adjacent to the: annular bushing receiving cavity (measurement D);

(6) forming a support cylinder (14 or 16 in FIGS. 1–3) having a diameter of about 0.010 inches less (or even lesser) than measurement A to provide about 0.005 inches or more of clearance between the bushing and the support cylinder, and with a length that does not exceed the length of the bushing;

(7) forming an annular rim (18 or 20 in FIGS. 1–3 ) about a base of the support cylinder and co-axial therewith, said rim having a length within about ±0.002 inches of measurement B, and an outside diameter that is about 0.005 inches less (or even lesser) than measurement C;

(8) forming an annular stopping flange (12 in FIGS. 1–3) at the bases of the support cylinder and rim and in co-axial orientation therewith, said flange extending radially far enough outward beyond the rim to prevent insertion of said flange into the annular bushing receiving cavity, but small enough to pass beyond any Stepped faces or other transmission structure in order to be able to abut against the first face, using measurement D as a reference, the length of the flange being dictated by ease of use, speed for performing the installation, ergonomics, and so forth.

The present invention represents a significant advance in the field of bushing installation in vehicle transmissions. It is noted that many of the advantages of the present invention accrue due to the reversible nature of the tool 10, and the depth control rims 18 and 20. The unique method of customizing the tool to specific bushing sizes enhances the utility thereof. The problems noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A dual-sided, reversible tool for installing a rigid bushing into an annular cavity of a vehicle transmission at a predetermined depth therein comprising:

a stopping flange having first and second opposing surfaces lying in substantially parallel planes;

first and second impact-transferring support cylinders rigidly disposed on the first and second surfaces of the stopping flange, respectively, and extending axially outward therefrom in opposite directions, each cylinder terminating in a free end and being uniformly cylindrical along its length when so rigidly disposed and having an outer diameter narrowly tailored to the inner diameter of a bushing so as to be physically configured to permit either cylinder to receive a bushing slidably over its free end in a close fit thereon;

depth control means disposed on the tool for limiting the insertion depth of a bushing into the annular vehicle transmission cavity, such that a bushing placed around one of the support cylinders is slidable along the cylinder between the free end thereof and said depth control means so as to be advanceable to a seated position against the depth control means so that a force applied to the other of the support cylinders is transferred through the depth control means to the bushing to thereby press fit said bushing into the cavity at a predetermined depth;

wherein the opposing surfaces of the stopping flange are substantially planer, and wherein each cylinder is narrowly tailored to have an outer diameter which is narrower than the inner diameter of a bushing to thereby permit either cylinder to be inserted into a bushing in a loose fit and to be retrievable therefrom despite radial contraction of said bushing during the press fitting procedure;

wherein the first and second support cylinders have substantially different outer diameters to thereby enable press fit installation of bushings having at least two different inner diameter sizes into annular vehicle transmission cavities;

wherein the depth control means comprises first and second annular rims disposed on the first and second flange surfaces and surrounding the first and second cylinders, respectively, said rims having predetermined, shorter lengths than their respective cylinders, so that a bushing placed upon one of the cylinders is engageable with the respective rim and separated thereby from the stopping flange during installation of said bushing, such that when said bushing is being pressed into the cavity, the stopping flange eventually engages with transmission structure to thereby prevent further advancement of said bushing therein;

wherein the stopping flange is substantially circular and positioned in substantial co-axial orientation with the cylinders;

wherein each cylinder further comprises an end face having a receiving slot formed therein for receiving an impact-transferring handle thereinto, said tool further comprising:

an impact-transferring handle having an extremity configured for insertion into the receiving slots, at least a portion of said handle being wider than the slots such that when said extremity is inserted into the receiving slot of one of the cylinders, said portion of the handle engages with the end face of said cylinder to thereby cause a force applied to said handle to pass through said handle into said cylinder.

2. A tool as in claim 1 wherein the handle further comprises an elongate cylinder including a positioning finger disposed on a distal end of said handle and extending axially outward therefrom in substantial co-axial orientation with said handle, said positioning finger for insertion into the receiving slots.

3. A tool as in claim 1 wherein the receiving slots are part of a single passage extending axially through both cylinders and the stopping flange and in substantial co-axial orientation with said cylinders and said flange.

4. A tool as in claim 3 wherein the outer diameter of the rims are configured to be no greater than the outer diameter of the respective bushings to be installed therewith to thereby permit the rims to fit easily within the annular cavities during installation of the bushings.

5. A tool as in claim 4 wherein at least one of the end faces of the cylinders is substantially planer and has an outer diameter within a range of approximately three inches to four inches, and wherein the receiving slot formed therein has a width within a range of approximately 0.5 inches to 0.75 inches.

6. A tool as in claim 5 wherein said tool is made from a rigid, polymeric material.

7. A tool as in claim 6 wherein said tool is made from a polyacetal material.

8. A dual-sided, reversible tool for installing a rigid bushing within an annular cavity of a vehicle transmission at a predetermined depth therein comprising:

a stopping flange having first and second opposing, substantially flat surfaces lying in substantially parallel planes;

first and second impact-transferring support cylinders disposed on the first and second surfaces of the flange, respectively, and extending axially outward therefrom in opposite directions, each cylinder further including an end face having a receiving slot formed therein for receiving an impact-transferring handle thereinto;

depth control means disposed on the tool for limiting the insertion depth of a bushing into the annular vehicle transmission cavity, such that a bushing placed around one of the support cylinders can be advanced to a seated position against the depth control means so that a force applied to the other of the cylinders is transferred through the depth control means to the bushing to thereby press fit said bushing into the cavity at a predetermined depth; and an impact-transferring handle having an extremity configured for insertion into the receiving slots, at least a portion of said handle being wider than the slots such that when said extremity is inserted into the receiving slot of one of the cylinders, said portion of the handle engages with the end face of said cylinder to thereby cause a force applied to said handle to pass through said handle into said cylinder.

9. A tool as in claim 8 wherein the depth control means comprises first and second annular rims disposed on the first and second flange surfaces and surrounding the first and second cylinders, respectively, said rims having predetermined, shorter lengths than their respective cylinders, so that a bushing placed upon one of the cylinders is engageable with the respective rim and separated thereby from the flange during installation of said bushing, such that when said bushing is being pressed into the cavity, the flange eventually engages with transmission structure to thereby prevent further advancement of said bushing therein.

10. A tool as in claim 9 wherein the handle further comprises an elongate cylinder including a positioning finger disposed on a distal end of said handle and extending axially outward therefrom in substantial co-axial orientation with said handle, said positioning finger for insertion into the receiving slots.

11. A tool as in claim 9 wherein the receiving slots are part of a single passage extending axially through both cylinders and the flange and in substantial co-axial orientation with the cylinders and the flange.

12. A tool as in claim 11 wherein the outer diameter of the rims are configured to be no greater than the outer diameter of the respective bushings to be installed therewith to thereby permit the rims to fit easily within the annular cavities during installation of the bushings.

13. A tool as in claim 12 wherein at least one of the end faces of the cylinders is substantially planer and has an outer diameter within a range of approximately three inches to four inches, and wherein the receiving slot formed therein has a width within a range of approximately 0.5 inches to 0.75 inches.

* * * * *